US007075359B2

(12) United States Patent
Chen

(10) Patent No.: US 7,075,359 B2
(45) Date of Patent: Jul. 11, 2006

(54) TWO PHASE INTERNAL VOLTAGE GENERATOR

(75) Inventor: Chieng-Chung Chen, Hsinchu (TW)

(73) Assignee: Winbond Electronics Corp., Hsinchu (TW)

( * ) Notice: Subject to any disclaimer, the term of this patent is extended or adjusted under 35 U.S.C. 154(b) by 0 days.

(21) Appl. No.: 10/605,080

(22) Filed: Sep. 8, 2003

(65) Prior Publication Data

US 2005/0007188 A1 Jan. 13, 2005

(30) Foreign Application Priority Data

Jul. 8, 2003 (TW) ..... 92118561 A

(51) Int. Cl.
*G05F 1/10* (2006.01)

(52) U.S. Cl. ..... 327/541; 327/546; 323/316

(58) Field of Classification Search ..... 327/536, 327/537, 538, 540, 541, 543; 363/59; 323/316
See application file for complete search history.

(56) References Cited

U.S. PATENT DOCUMENTS 4,683,382 A * 7/1987 Sakurai et al. ..... 327/544
5,072,134 A * 12/1991 Min ..... 327/536
5,721,485 A * 2/1998 Hsu et al. ..... 327/540
5,821,808 A * 10/1998 Fujima ..... 327/540
5,909,141 A * 6/1999 Tomishima ..... 327/536
5,929,696 A * 7/1999 Lim et al. ..... 327/540
6,002,295 A * 12/1999 Gens et al. ..... 327/546
6,031,411 A * 2/2000 Tsay et al. ..... 327/536
6,128,242 A * 10/2000 Banba et al. ..... 365/226
6,184,744 B1 * 2/2001 Morishita ..... 327/541
6,563,371 B1 * 5/2003 Buckley et al. ..... 327/539
6,661,279 B1 * 12/2003 Yabe ..... 327/546
6,762,960 B1 * 7/2004 Natori ..... 365/189.09

* cited by examiner

*Primary Examiner*—Terry D. Cunningham
(74) *Attorney, Agent, or Firm*—Jiang Chyun IP Office

(57) ABSTRACT

A two phase internal voltage generator at least includes a first phase internal voltage generator and a second phase internal voltage generator. The power consumption of the second phase internal voltage generator is relatively lower than that of the first phase internal voltage generator. The first phase internal voltage generator promptly generates and provides a first internal voltage source when an external power is provided. As a second internal voltage source that is provided by the second phase internal voltage generator is stable, the first phase internal voltage generator cuts off the supply of the first internal voltage source. The present invention prevents the problem to major power consumption for conventional internal voltage generator.

7 Claims, 3 Drawing Sheets

TWO PHASE INTERNAL VOLTAGE GENERATOR

CROSS REFERENCE TO RELATED APPLICATIONS

This application claims the priority benefit of Taiwan application serial no. 92118561, filed on Jul. 8, 2003.

BACKGROUND OF INVENTION

1. Field of Invention

The present invention relates to an integrated circuit of an internal voltage generator. More particularly, the present invention relates to a two phase internal voltage generator providing low current consumption, which is adapted to low-power integrated circuit.

2. Description of Related Art

As scientific technology advances and environmental consciousness awakens, integrated circuitry proceeds towards high speed operation and low power consumption accordingly. Therefore, power saving and size reducing scheme as well as enhanced functions are thus introduced to varieties of electronic products. It is a major object to substantially realize low power consumption for Integrated Circuits (IC), for example, low power consumption Dynamic Random Access Memory (DRAM). Undoubtedly, low power scheme is particularly significant for Personal Computer (PC) market as well as consumer electronics market.

FIG. 1 illustrates a circuit of a conventional internal voltage generator. The conventional internal voltage generator is for generating and providing steady and regulated internal voltage source, where the internal voltage source VINT is different from an external voltage source VEXT. The external voltage source varies within the range from 2.3V to 2.7 V while the internal voltage VINT is fixed at 2.1V, for example.

Referring to FIG. 1, the internal voltage generator 10 comprises a comparator 12, an NMOS power transistor 14, a resistor R1 and another resistor R2. It is known from FIG. 1 that the internal voltage generator 10 comprises a feedback loop, wherein resistors R1 and R2 serves as a voltage divider for internal voltage VINT and feeds the divided voltage back to the comparator 12. Comparison between the feedback voltage and reference voltage vREFDC performed by comparator 12 hereby controls the NMOS power transistor 14 so as to obtain the internal voltage VINT.

In this conventional internal voltage generator 10, the resistors R1 and R2 are serially connected wherein the two ends of each resistor couple to the internal voltage and ground respectively, thus considerable direct current (dc current) is consumed thereby, i.e. significant dc current is consumed under active mode. Assuming the internal voltage generator applying to DRAM and the active dc current being 600 μA, as the DRAM operates a self refresh, there is supposed to be 8 internal voltage generator operating simultaneously, such that an average active dc current is: 30 μA=(600 μA*8*100 nS)/16 μS, where power consumption is considerably large, which means such IC is hardly referred as a low power consumption IC that conventional internal voltage generator 10 does not qualify a low power consumption IC.

SUMMARY OF INVENTION

The invention provides a two phase internal voltage generator and a generating method to improve major power consumption problem in conventional internal voltage generator as much as to conformp6p6 to low-power consumption IC.

Therefore, the invention provides a two phase internal voltage generator at least comprising a first phase internal voltage generator and a second phase internal voltage generator, wherein the second phase voltage generator consumes lower power than the first internal voltage generator. When an external voltage is received, the first internal voltage generator promptly generates a first internal voltage, yet the first-phase internal voltage generator cuts off the power provided therein when a second voltage power that is provided by the second internal voltage generator manages to be steady.

The two phase internal voltage generator as embodied and broadly described according to one preferred embodiment in the present invention herein, the second-phase internal voltage generator comprises a voltage pump generator, a input gate voltage generator, and a power output circuit. The voltage pump generator pumps up an external voltage in order to provide a pumped voltage according to a first control signal. The input gate voltage generator steps down and regulates the pumped voltage to an input gate voltage according to a second control signal. As to the power output circuit, it steadily provides the second internal voltage source according to the input gate voltage, wherein the power output circuit may comprise a power transistor, e.g. a NMOS power transistor. The first phase internal voltage generator cuts off the first internal voltage source that is supplied therein according to a third control signal in one preferred embodiment of this present invention.

Regarding the foregoing two phase internal voltage generator in one preferred embodiment of this present invention, the internal operation steps are described as follows. As external voltage is firstly received, a first internal voltage source is provided promptly by the first phase internal voltage generator therein. A first control signal is generated thereby thus actuates the voltage pump generator to provide pumped voltage. A second control signal is then generated thereby to actuate the input gate voltage generator that provides input gate voltage as well as activates power output circuit to steadily provide a second internal voltage source. Ultimately a third control signal is generated so as to cut off the first internal voltage source supplied thereby the first phase internal voltage generator.

According to another aspect of this present invention, a two phase internal voltage generating method is provided which complies to an integrated circuit that is composed of a first phase internal voltage generator and a second phase internal voltage generator. Notice that the second phase internal voltage generator consumes relatively lower power than the first internal voltage generator, wherein the two phase internal voltage generating method comprises the following steps successively. As external voltage is firstly received, a first internal voltage source is provided promptly by the first phase internal voltage generator therein. The external voltage is pumped by the second phase internal voltage generator to obtain a pumped voltage that is to be stepped down and regulated in order to obtain an input gate voltage, whereas second internal voltage source is thus provided according to the input gate voltage therein. Ultimately the forgoing first phase internal voltage generator cuts off the first internal voltage source accordingly.

In this present invention a structure of two phase internal voltage generator is introduced. The first phase internal voltage generator which is more power consuming promptly provides a steady first internal voltage source. As the second internal voltage provided by the second phase internal voltage generator is steadied, the first internal voltage generator cuts off the first internal voltage therein, so as to improve the issue over power consumption.

These and other objects, features and advantages of the present invention will become apparent from the following detailed description of illustrative embodiments thereof, which is to be read in connection with the accompanying drawings.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
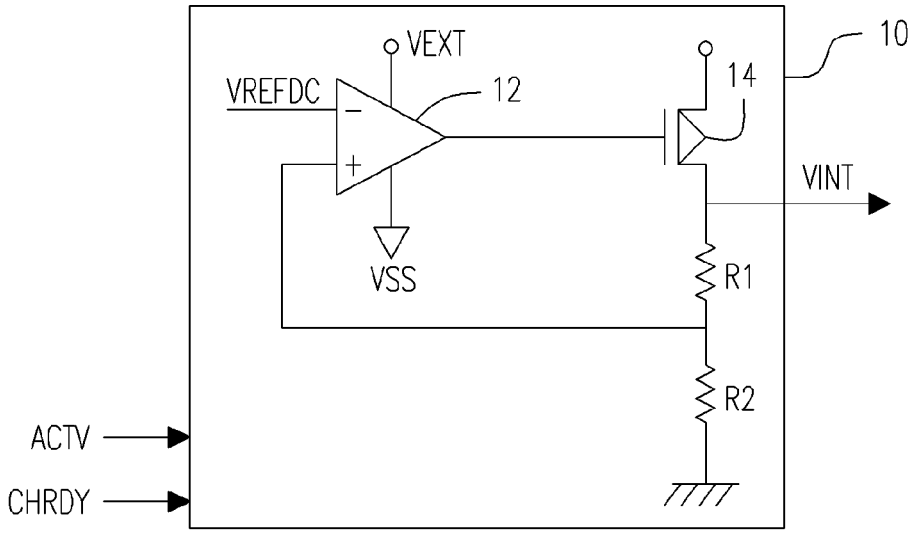
FIG. 1 illustrates a circuit of a conventional internal voltage generator.
Figure 2:
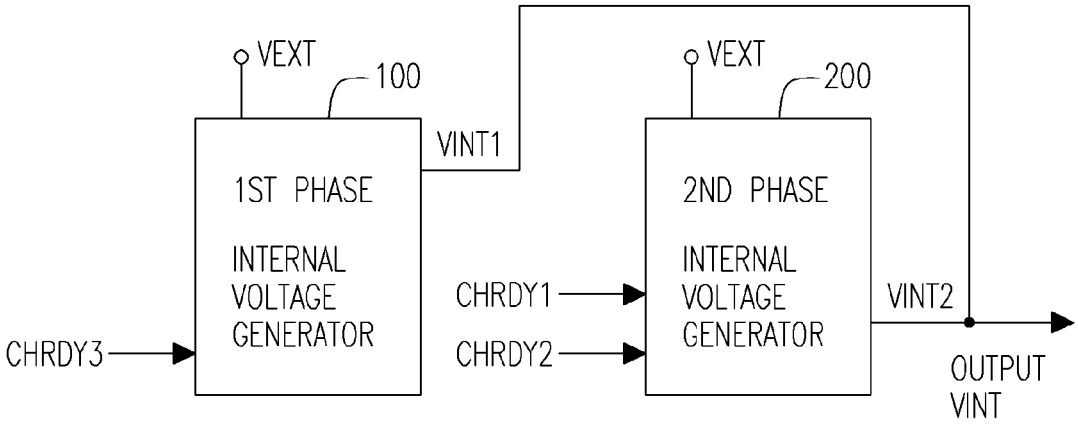
FIG. 2 illustrates a block diagram of a two phase internal voltage generator circuit according to one preferred embodiment of this invention.

Referring to FIG. 2, a circuit block diagram of a two phase internal voltage generator is illustrated according to one preferred embodiment of this present invention. This present invention provides a two phase internal voltage generator comprising at least a first phase internal voltage generator 100 and a second phase internal voltage generator 200, wherein the second phase internal voltage generator 200 consumes relatively lower power than the first phase internal voltage generator 100. For instance, as DRAM performs self-refresh, eight of the internal voltage generators operate simultaneously consuming an average active current of 30 μA while a first phase internal voltage generator 100 consumes an active dc current of 600 μA assuming the first internal voltage generator 100 is introduced herein the DRAM. Contrarily, if a second internal voltage generator 200 is introduced to a DRAM circuit, an average active current consumption is merely 0.5 μA as calculated accordingly.

One object of the first phase internal voltage generator 100 is to provide a steady first internal voltage source, which is expressed as VINT1 herein. While the power is operating, the first phase internal voltage generator 100 promptly provides a steady first internal voltage source as long as an external voltage source VEXT is detected. In this one preferred embodiment, the first phase internal voltage generator 100 cuts off the first internal voltage source according to a third control signal CHRDY3. Whereas the second internal generator 200 is introduced to provide a steady second internal voltage expressed as VINT2. One of the characteristics of this present invention is as the second internal voltage source provided by the second phase internal voltage generator 200 is regulated, the third control signal CHRDY3 actuates the first phase internal voltage generator 100 so as to cut off the first internal voltage source therein.

Figure 3:
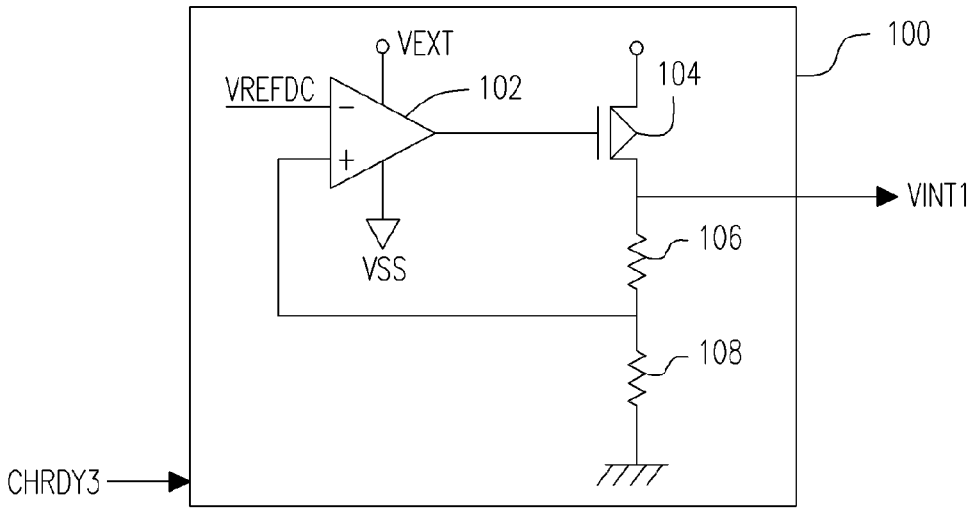
FIG. 3 illustrates the circuit of the first phase internal voltage generator 100 of the two phase internal voltage generator according to one preferred embodiment of this invention.

Referring to FIG. 3, a circuit diagram of the first phase internal voltage generator 100 of the two phase internal voltage generator in FIG. 2 is illustrated herein. In FIG. 3, the first phase internal voltage generator 100 comprises a comparator 102, a NMOS power transistor 104, a first resistor 106, and a second resistor 108. It is noted that the first source/drain terminal of the NMOS power transistor 104 couples to an external voltage source, where an internal VINT1 is output accordingly. A first terminal of the first resistor 106 couples to a second source/drain terminal of the NMOS power transistor 104, whereas the first terminal of the second resistor 108 couples to the a second terminal of the first resistor 106 so as to provide feedback voltage. A second terminal of the second resistor 108 is grounded. The first internal voltage VINT1 divided by the first resistor 106 and the second resistor 108 feeding voltage back to the comparator 102, where the comparison between this feedback voltage and a reference voltage vREFDC is taken place therein so as to control the gate of the NMOS power transistor. A steady first internal voltage VINT1 is thus generated thereof.

Figure 4:
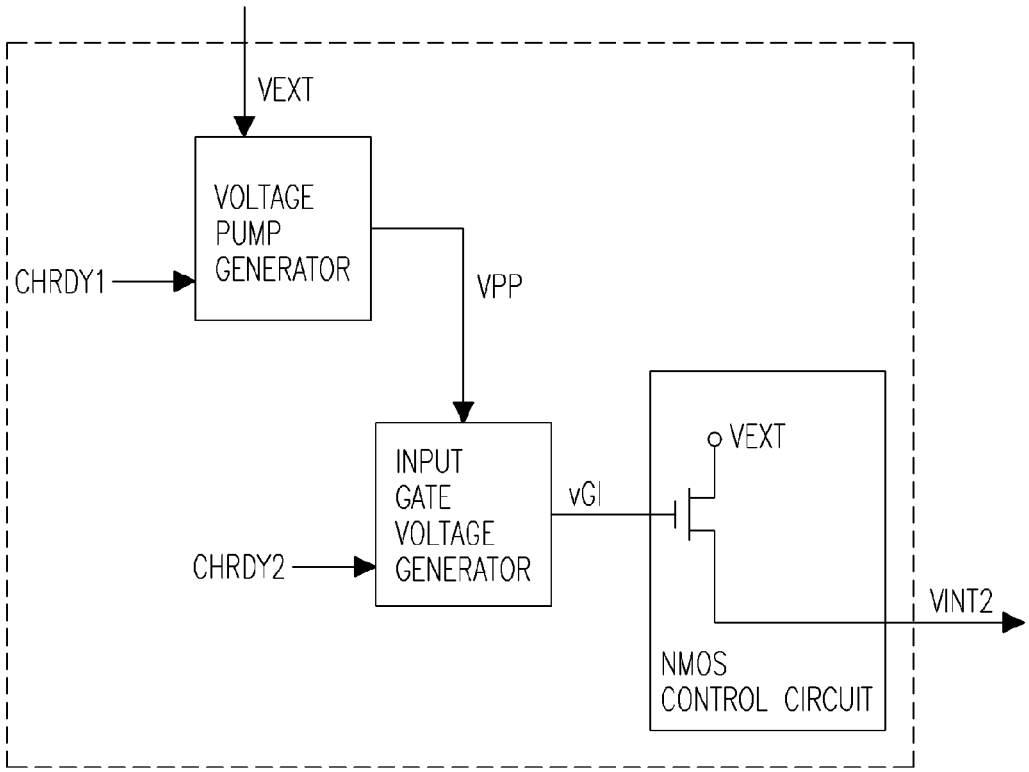
FIG. 4 illustrates the circuit of the second phase internal voltage generator 200 of the two phase internal voltage generator according to one preferred embodiment of this invention.

Referring to FIG. 4, a circuit block diagram of the second phase internal voltage generator 200 of the two phase internal voltage generator shown in FIG. 2 is illustrated therein. In FIG. 4, there is the two phase internal voltage generator according to one preferred embodiment of this present invention, wherein the second phase internal voltage generator 200 comprises a voltage pump generator 202, an input gate voltage generator 204, and a power output circuit 208. The voltage pump generator 202 pumps up and external voltage VEXT of the external voltage source to provide a pumped voltage VPP according to the first control voltage CHRDY1. The input gate voltage generator 204 steps down the pumped voltage VPP and regulates the voltage to input gate voltage vGI according to the second control signal CHRDY2. The power output circuit 206 provides a second internal voltage source VINT2 based on input gate voltage vGI where a NMOS power transistor 208 is introduced. As to the NMOS power transistor 208, the gate couples to the input gate voltage vGI, whereas a first source/drain terminal couples to the external voltage and a second source/drain terminal couples to the second internal voltage source.

It will be apparent to those skilled in the art that both the foregoing NMOS power transistors 104 and 208 are not MOS type power transistors. Other larger power transistors that provide steadiness of voltage fall in the scope or spirit of the present invention.

Figure 5:
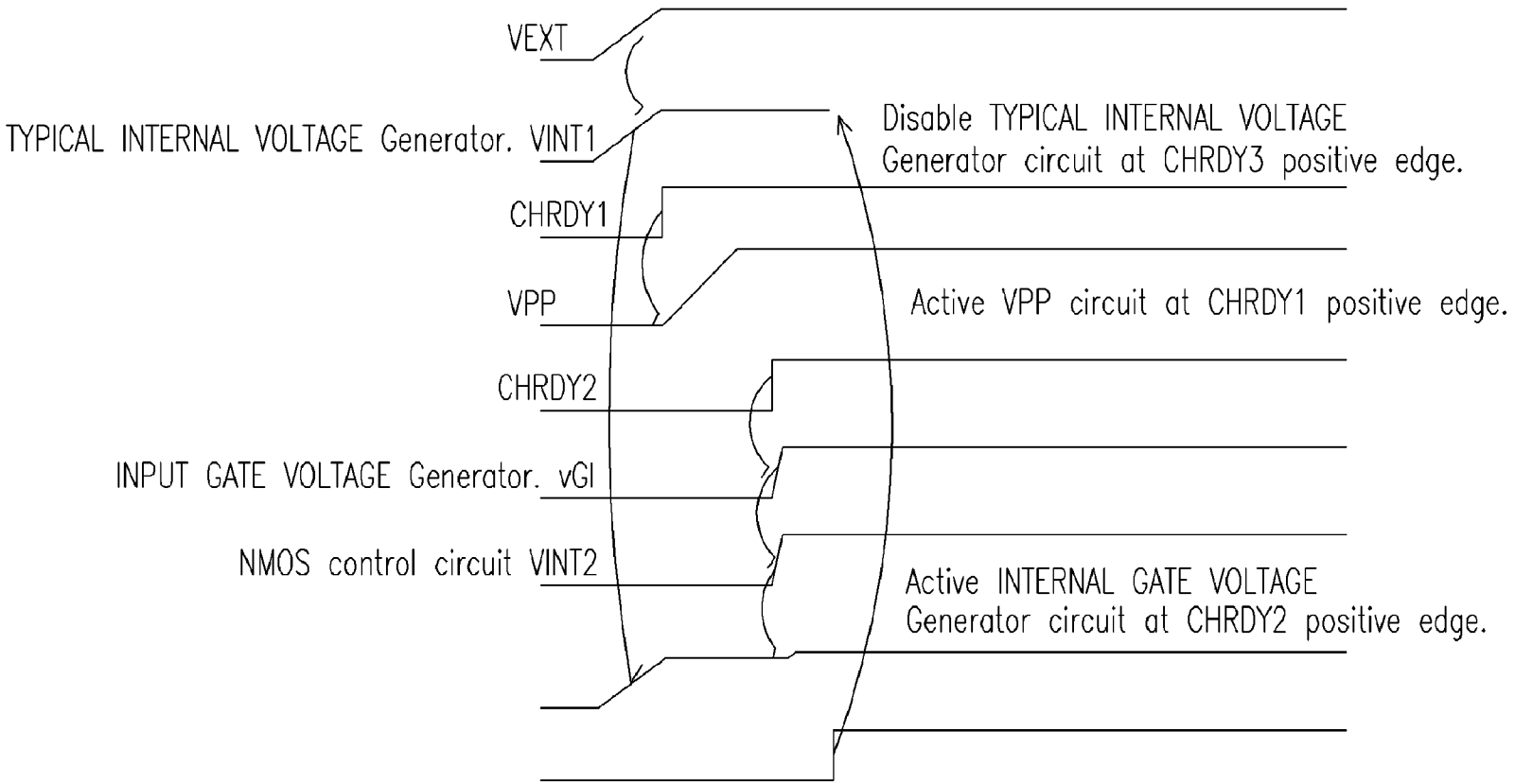
FIG. 5 illustrates an internal operating clock diagram for the two phase internal voltage generator according to one preferred embodiment of this invention.

In FIG. 5, an internal operation time chart of a two phase internal voltage generator in one preferred embodiment of the present invention is illustrated therein. Referring to FIG. 5 as well as FIG. 2 and FIG. 4, the internal operating steps of the two phase internal voltage generator in one preferred embodiment of this present invention are described as follows. The first-phase internal voltage generator 100 promptly provides a first internal voltage source upon an external voltage source being received, i.e. the external voltage VEXT being increased, so that the first internal voltage VINT1 increases accordingly. A first control signal CHRDY1 is actuated so as to activate voltage pump generator 202 to provided pumped voltage VPP. Thus a second control signal CHRDY2 is actuated by the pumped voltage VPP, so as to activate input gate voltage generator 204 to generate an input gate voltage vGI as well as to activate power output circuit 206 to steadily provide the second internal voltage source expressed as VTNT2. Ultimately, a third control signal CHRDY3 is actuated for the second phase Internal voltage generator 200 to cut off the first internal voltage source therein.

Conclusively, according to ap23p23nother aspect of this present invention, a two phase internal voltage generating method is provided which conforms to an integrated circuit that is composed of a first phase internal voltage generator and a second phase internal voltage generator. Notice that the second phase internal voltage generator consumes relatively lower power than the first internal voltage generator, wherein the two phase internal voltage generating method comprises the following steps successively. An external voltage is firstly received, a first internal voltage source is provided promptly by the first phase internal voltage generator therein. The external voltage is pumped by the second phase internal voltage generator to obtain a pumped voltage that is stepped down and regulated in order to obtain an input gate voltage, whereas second internal voltage source is thus provided according to the input gate voltage therein. Ultimately the foregoing first phase internal voltage generator cuts off the first internal voltage source accordingly.

In this present invention a structure of two phase internal voltage generator is introduced. The first phase internal voltage generator which is more power consuming promptly provides a steady first internal voltage source. As the second internal voltage provided by the second phase internal voltage generator is steadied, the first internal voltage generator cuts off the first internal voltage therein, so as to improve the issue over power consumption.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A two phase internal voltage generator, comprising a first phase internal voltage generator for providing a first internal voltage source upon receiving an external voltage source, wherein the first phase internal voltage generator comprising:

a comparator, for comparing a reference voltage and a feedback voltage, outputting a control voltage;

a power transistor, wherein the gate terminal of the power transistor couples to the control voltage, the first source/drain terminal of the power transistor couples to the external voltage source, and the second source/drain terminal of the power transistor couples to the first internal voltage source;

a first resistor, having a first terminal and a second terminal, wherein the first terminal couples to the second source/drain terminal of the power transistor; and a second resistor, having a first terminal and a second terminal, wherein the first terminal couples to the second terminal of the first resistor so as to provide the feedback voltage, and the second terminal is grounded; and a second phase internal voltage generator for providing a second internal voltage source, the second phase internal voltage generator consumes relatively lower power than the first phase internal voltage generator;

wherein as the second internal voltage source that is provided by the second phase internal voltage generator is steadied, the first internal voltage source that is supplied by the first phase internal voltage generator is cut off thereby;

wherein the second phase internal voltage generator is turned on substantially immediately after the first internal voltage source is provided.

2. The two phase internal voltage generator as recited in claim 1, the second internal voltage generator comprises:

a voltage pump generator, for pumping up voltage of the external voltage source for providing a pumped voltage according to a first control signal;

an input gate voltage generator, coupling to the voltage pump generator, for stepping-down and regulating the pumped voltage to an input gate voltage; and a power output circuit, coupling to the input gate voltage generator, for steadily providing the second internal voltage source according to the input gate voltage.

3. The two phase internal voltage generator as recited in claim 2, the first phase internal voltage generator cuts off the first internal voltage source supplied by the first phase internal voltage generator according to a third control signal.

4. The two phase internal voltage generator as recited in claim 2, the power output circuit comprising a power transistor, wherein the gate terminal of the power output circuit couples to the input gate voltage, a first source/drain terminal power output circuit couples to the external voltage source, and a second source/drain terminal power output circuit outputs the second internal voltage source.

5. The two phase internal voltage generator as recited in claim 4, wherein the power transistor is an NMOS power transistor.

6. A two phase internal voltage generating method, being applied to an integrated circuit having a first phase internal voltage generator and a second phase internal voltage generator wherein the second phase internal voltage generator consumes relatively lower power than the first phase internal voltage generator, the steps of the two phase internal voltage generating method successively comprise:

a first internal voltage source being promptly provided by the first phase internal voltage generator upon receiving an external voltage source;

an input gate voltage obtaining from stepping-down and regulating a pumped voltage that is obtained from pumping the external voltage source generated by the second internal voltage generator, and a second internal voltage source being provided according to the input gate voltage; and the first internal voltage source, supplied by the first phase internal voltage generator, being cut off when the second internal voltage source is steadied, wherein the second phase internal voltage generator is turned on substantially immediately after the first internal voltage source is provided, wherein the second phase internal voltage generator comprises:

a voltage pump generator, for providing the pumped voltage that is pumped up from voltage of the external voltage source according to the first control signal;

an input gate voltage generator, coupling to the voltage pump generator, for stepping down and regulating the pumped voltage to the input gate voltage according to a second control signal; and a power output circuitry, coupling to the input gate voltage generator, for steadily providing the second internal voltage source according to the input gate voltage, wherein the first phase internal voltage generator cuts off the first internal voltage source supplied by the first phase internal voltage generator according to a third control signal, wherein the steps successively comprise:

the first internal voltage source being promptly provided by the first phase internal voltage generating method upon receiving the external voltage source;

the first control signal being actuated, so as to activate the voltage pump generator to provide the pumped voltage;

the second control signal being actuated, so as to activate the input gate voltage generator to output the input gate voltage as well as to activate the power output circuitry to steadily provide the second internal voltage source; and the third control signal being actuated, so that the first internal voltage source supplied by the first phase internal voltage generator is cut off.

7. A two phase internal voltage generating method, being applied to an integrated circuit having a first phase internal voltage generator and a second phase internal voltage generator wherein the second phase internal voltage generator consumes relatively lower power than the first phase internal voltage generator, the steps of the two phase internal voltage generating method successively comprise:

a first internal voltage source being promptly provided by the first phase internal voltage generator upon receiving an external voltage source;

an input gate voltage obtaining from stepping-down and regulating a pumped voltage that is obtained from pumping the external voltage source generated by the second internal voltage generator, and a second internal voltage source being provided according to the input gate voltage; and the first internal voltage source, supplied by the first phase internal voltage generator, being cut off, wherein the second phase internal voltage generator comprises:

a voltage pump generator, for providing the pumped voltage that is pumped up from voltage of the external voltage source according to the first control signal;

an input gate voltage generator, coupling to the voltage pump generator, for stepping down and regulating the pumped voltage to the input gate voltage according to a second control signal; and a power output circuitry, coupling to the input gate voltage generator, for steadily providing the second internal voltage source according to the input gate voltage, wherein the first phase internal voltage generator cuts off the first internal voltage source supplied by the first phase internal voltage generator according to a third control signal, wherein the steps successively comprise:

the first internal voltage source being promptly provided by the first phase internal voltage generating method upon receiving the external voltage source;

the first control signal being actuated, so as to activate the voltage pump generator to provide the pumped voltage;

the second control signal being actuated, so as to activate the input gate voltage generator to output the input gate voltage as well as to activate the power output circuitry to steadily provide the second internal voltage source; and the third control signal being actuated, so that the first internal voltage source supplied by the first phase internal voltage generator is cut off.

* * * * *